US012653367B2

(12) United States Patent
Miao et al.

(10) Patent No.: US 12,653,367 B2
(45) Date of Patent: Jun. 16, 2026

(54) CLEANING BASE AND CLEANING SYSTEM

(71) Applicant: WUXI LITTLE SWAN ELECTRIC CO., LTD., Wuxi (CN)

(72) Inventors: Yulai Miao, Wuxi (CN); Hao Jiang, Wuxi (CN); Fei Tang, Wuxi (CN)

(73) Assignee: WUXI LITTLE SWAN ELECTRIC CO., LTD., Wuxi (CN)

( * ) Notice: Subject to any disclaimer, the term of this patent is extended or adjusted under 35 U.S.C. 154(b) by 34 days.

(21) Appl. No.: 18/574,546

(22) PCT Filed: May 11, 2023

(86) PCT No.: PCT/CN2023/093551

§ 371 (c)(1),
(2) Date: Dec. 27, 2023

(87) PCT Pub. No.: WO2023/221859

PCT Pub. Date: Nov. 23, 2023

(65) Prior Publication Data

US 2024/0180389 A1 Jun. 6, 2024

(30) Foreign Application Priority Data

May 17, 2022 (CN) ..... 202210542287.5
May 17, 2022 (CN) ..... 202221231616.6

(51) Int. Cl.
*A47L 11/40* (2006.01)
*D06F 39/12* (2006.01)

(52) U.S. Cl.
CPC ..... *A47L 11/4091* (2013.01); *D06F 39/12* (2013.01); *A47L 2201/024* (2013.01); *A47L 2201/026* (2013.01); *A47L 2201/028* (2013.01)

(58) Field of Classification Search
CPC ..... A47L 11/282; A47L 11/4083; A47L 11/4091; A47L 2201/024; A47L 2201/026;
(Continued)

(56) References Cited

U.S. PATENT DOCUMENTS 10,590,593 B1 3/2020 Leibman et al.
2018/0368646 A1 12/2018 Buehler et al.

FOREIGN PATENT DOCUMENTS

CN 106510556 A * 3/2017 ..... A47L 11/4094
CN 209301015 U 8/2019
(Continued)

OTHER PUBLICATIONS

CN113243858A machine translation (Year: 2021).*
(Continued)

*Primary Examiner* — Douglas Lee
(74) *Attorney, Agent, or Firm* — Scully, Scott, Murphy & Presser, P.C.

(57) ABSTRACT

A cleaning base used for laundry treatment is provided. The cleaning base includes a bottom frame and a water inlet pipeline. A cleaning portion, and a cleaning cavity for containing a ground cleaning device are formed in the base. The cleaning portion is used for cleaning at least part of the ground cleaning device. The water inlet pipeline is in communication with the cleaning portion and a tap water source. Since the water inlet pipeline is in communication with the tap water source, it is not necessary to provide a water storage structure having a large structural size for the cleaning base. The overall structural size of the cleaning base is reduced. The tap water source can continuously supply water to a cleaning tank. Thus, a user does not need to manually add water to the water storage structure.

15 Claims, 6 Drawing Sheets

(58) Field of Classification Search
CPC .... A47L 2201/028; A47L 11/24; A47L 11/40; A47L 2201/00; A47L 2201/02; A47L 2201/022; D06F 39/12; D06F 39/022; D06F 39/083; D06F 39/088; D06F 39/125
See application file for complete search history.

(56) References Cited

FOREIGN PATENT DOCUMENTS

| | | | | | |
|---|---|---|---|---|---|
| CN | 110448242 | A | | 11/2019 | |
| CN | 110693394 | A | | 1/2020 | |
| CN | 112294201 | A | | 2/2021 | |
| CN | 212546846 | U | | 2/2021 | |
| CN | 112575542 | A | | 3/2021 | |
| CN | 113062091 | A | | 7/2021 | |
| CN | 213588194 | U | | 7/2021 | |
| CN | 113243858 | A | * | 8/2021 | ..... A47L 11/4025 |
| CN | 113440075 | A | * | 9/2021 | ..... A47L 11/4011 |
| CN | 113520243 | A | | 10/2021 | |
| CN | 113541223 | A | | 10/2021 | |
| CN | 113576347 | A | | 11/2021 | |
| CN | 113693519 | A | * | 11/2021 | ..... A47L 11/4016 |
| CN | 215016834 | U | | 12/2021 | |
| CN | 114176468 | A | | 3/2022 | |
| CN | 215914425 | U | | 3/2022 | |
| CN | 215914461 | U | * | 3/2022 | |
| CN | 215959662 | U | | 3/2022 | |
| CN | 216006354 | U | | 3/2022 | |
| CN | 216124370 | U | | 3/2022 | |
| CN | 216147983 | U | | 4/2022 | |
| CN | 216364947 | U | | 4/2022 | |
| CN | 114903377 | A | | 8/2022 | |
| CN | 217324644 | U | | 8/2022 | |
| CN | 217429894 | U | | 9/2022 | |
| JP | 2005143789 | A | * | 6/2005 | ..... A47L 15/46 |
| JP | 2019017952 | A | | 2/2019 | |
| JP | 2019115789 | A | | 7/2019 | |
| RU | 2699837 | C1 | | 9/2019 | |
| WO | 2022096004 | A1 | | 5/2022 | |

OTHER PUBLICATIONS

CN113693519A machine translation (Year: 2021).*
CN215914461U machine translation (Year: 2022).*
CN106510556A machine translation (Year: 2017).*
JP2005-143789A machine translation (Year: 2005).*
Notification of Grant of Invention Patent dated Aug. 26, 2022 received in Chinese Patent Application No. 202221231616.6.
Office Action dated Jun. 3, 2024 received in Russian Patent Application No. 2023133967/03.
International search report and written opinion dated Aug. 7, 2023 received in International Application No. PCT/CN2023/093551.
Extended European search report dated Oct. 21, 2024 received in European Patent Application No. 23806811.8.
Decision of Rejection dated Jan. 1, 2025 received in Chinese Patent Application No. 202410074745.6.
First Office Action dated May 26, 2025 received in Chinese Patent Application No. 202210542287.5.
First Office Action dated Jul. 10, 2024 received in Chinese Patent Application No. 202410074745.6.
Second Office Action dated Nov. 20, 2024 received in Chinese Patent Application No. 202410074745.6.
Office Action dated Feb. 14, 2026 received in Chinese Patent Application No. 202210542287.5.

* cited by examiner

CLEANING BASE AND CLEANING SYSTEM

CROSS-REFERENCE TO RELATED APPLICATIONS

This application is a National Stage Entry under 35 U.S.C. § 371 of PCT International Application No. PCT/CN2023/093551, filed on May 11, 2023, which claims priority to Chinese Patent Application No. 202210542287.5, filed on May 17, 2022, and Chinese Patent Application No. 202221231616.6, filed on May 17, 2022, the entire contents of each of which are hereby incorporated by reference in their entirety.

TECHNICAL FIELD

The present disclosure relates to the technical field of electrical cleaning appliances, and provides a cleaning base and a cleaning system.

BACKGROUND

The robot vacuum cleaner not only has the function of sweeping the floor, but also has the function of mopping the floor with a mop, which effectively reduces the labor intensity of manual cleaning. In the related technology, the station is provided with a clear water tank, and the mop of the robot vacuum cleaner is cleaned by using clear water in the clear water tank. However, the clear water tank leads to the large structural size of the station.

SUMMARY

In view of this, the present disclosure aims to propose a cleaning base having a more compact structure and a cleaning system.

An aspect of the present disclosure provides a cleaning base comprising: a bottom frame and a water inlet pipeline.

A cleaning portion and a cleaning chamber for accommodating a floor cleaning device are formed inside the bottom frame.

The water inlet pipeline fluidly connects the cleaning portion with a water source.

In some embodiments, the cleaning base comprises a water inlet valve arranged in the water inlet pipeline.

In some embodiments, the cleaning base comprises a cleaning port located in the cleaning chamber, and the cleaning port is arranged at a water outlet of the water inlet pipeline.

In some embodiments, a top side of the bottom frame is provided with a water inlet port, and the water inlet pipeline is fluidly connected to the water inlet port.

In some embodiments, the bottom frame comprises a support frame and a base frame, a receiving cavity is formed in the support frame, the base frame is located in the receiving cavity, the cleaning portion and the cleaning chamber having an opening on a front side are formed in the base frame, and the water inlet valve is located in the receiving cavity.

In some embodiments, the cleaning base comprises a pressure relief tank which is arranged in the water inlet pipeline and located downstream of the water inlet valve.

In some embodiments, the cleaning base comprises a detergent canister in communication with the pressure relief tank.

In some embodiments, the cleaning base comprises a self-feeding pump configured to pump a detergent contained in the detergent canister.

In some embodiments, the pressure relief tank comprises a liquid inlet fluidly connected with a water outlet of the water inlet valve, a liquid outlet fluidly connected with the cleaning portion and a feed inlet fluidly connected with the detergent canister, a height of the liquid inlet and a height of the feed inlet are higher than that of the liquid outlet.

In some embodiments, the cleaning base comprises a water discharge pipeline fluidly connecting the cleaning portion with a water outlet pipeline of the laundry treatment device.

In some embodiments, the cleaning base comprises a water discharge tank, a water discharge pump and a water supplementing pipeline, the water discharge pump and the water discharge tank are arranged in the water discharge pipeline, the water discharge pump is located downstream of the water discharge tank, two ends of the water supplementing pipeline are fluidly connected to the water discharge tank and the water inlet pipeline, respectively.

Another aspect of the present disclosure provides a cleaning system comprising:

- the cleaning base according to any one of the above embodiments;
- a laundry treatment device arranged above the bottom frame; and
- a floor cleaning device which is movable into and out of the cleaning chamber.

In some embodiments, the laundry treatment device comprises a water intake pipeline, the water inlet pipeline is fluidly connected with the water intake pipeline, and the water intake pipeline is fluidly connected with the water source.

In some embodiments, a bottom of the laundry treatment device is provided with a water intake port fluidly connected with a water inlet port on a top side of the bottom frame, and the water intake pipeline is fluidly connected with the water intake port.

In some embodiments, the water intake pipeline and the water inlet pipeline are located on the same side of the bottom frame.

In the cleaning base of the embodiment of the present disclosure, the water inlet pipeline is fluidly connected with the water source, so there is no need to provide a water storage structure with a large structural size for the cleaning base, and the overall structural size of the cleaning base can be reduced. The water source may continuously supply water to the cleaning portion, without the user having to manually supply the water to the water storage structure, thus increasing the automation level and operating convenience of the station.

DETAILED DESCRIPTION

It should be noted that the embodiments in the present disclosure and the technical features in the embodiments can be combined with each other as long as they do not conflict with each other. The detailed description in the particular embodiments should be understood as an explanation of the purposes of the present disclosure and should not be regarded as an undue restriction on the present disclosure.

Figure 1:
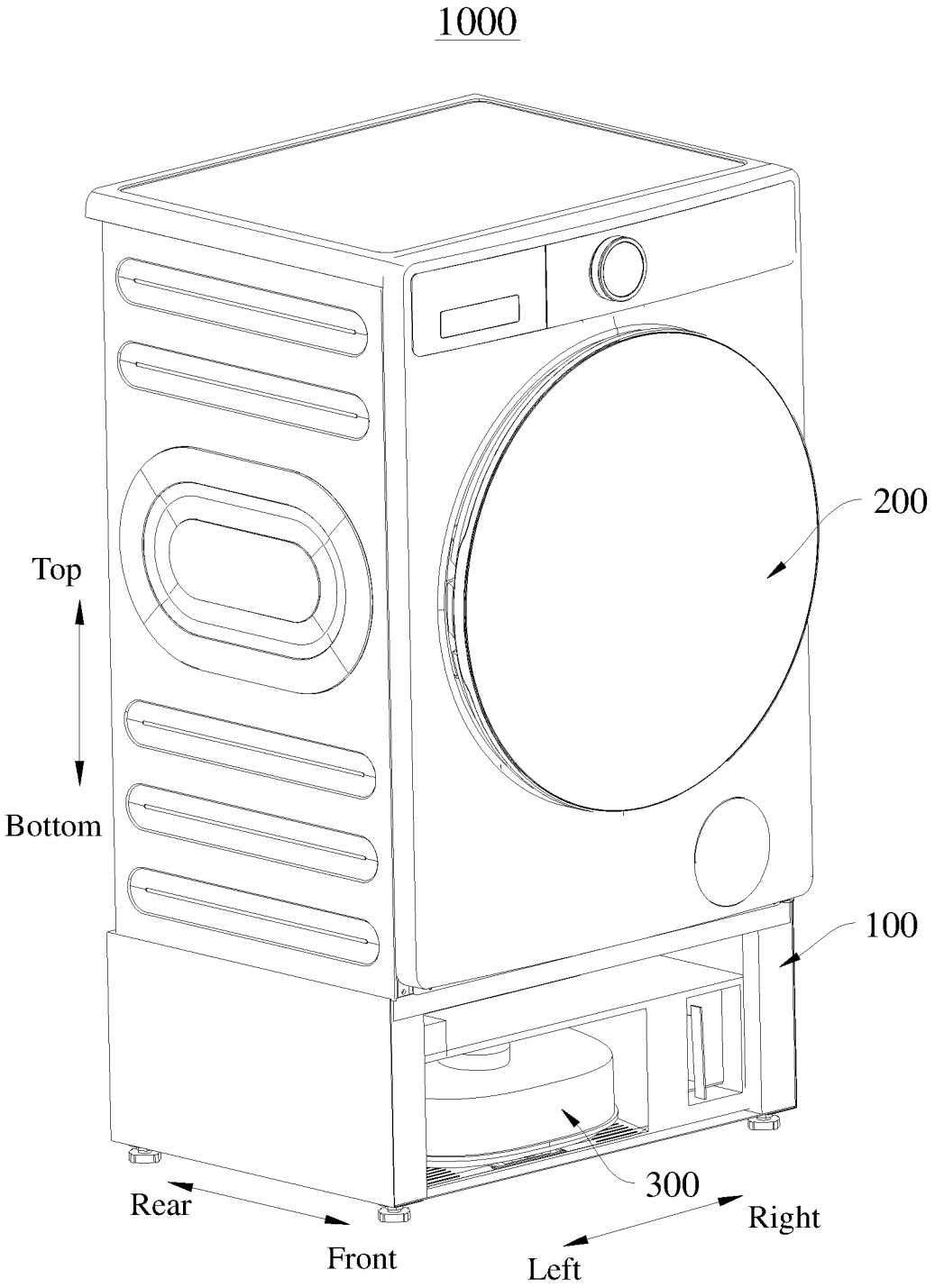
FIG. 1 is a schematic view of a cleaning system according to an embodiment of the present application.
Figure 5:
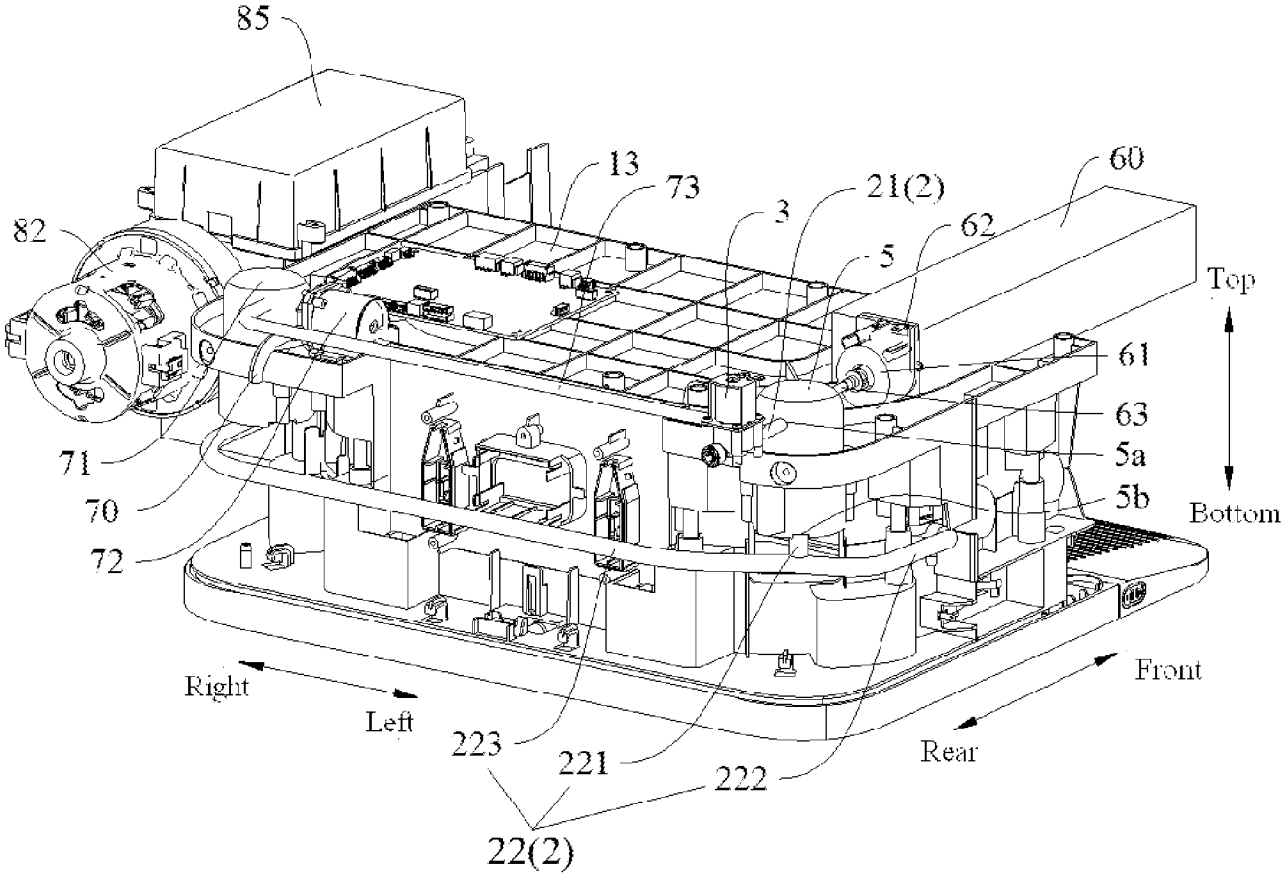
FIG. 5 is an exploded view of the cleaning station in FIG. 2, in which the main structure within the base is schematically shown.

In the embodiment of the present disclosure, the directional or positional terms "above" and "below", "top" and "bottom", "left" and "right", "front" and "rear" are used in reference to the cleaning base in normal use. For example, the directional and positional relationship is shown in FIGS. 1 and 5. The term "first/second" merely refers to the distinction between different objects, and does not mean that there are similarities or connections between them. It should be understood that these directional terms are intended only for the convenience of describing the present application and simplifying the description, and are not intended to indicate or imply that the device or element must have a specific orientation, be constructed and operated in a specific orientation, and therefore cannot be understood as a restriction on the present disclosure.

The present disclosure provides a cleaning base 100. Referring to FIGS. 1-3 and 6, the cleaning base 100 includes a bottom frame 1 and a water inlet pipeline 2.

Figure 2:
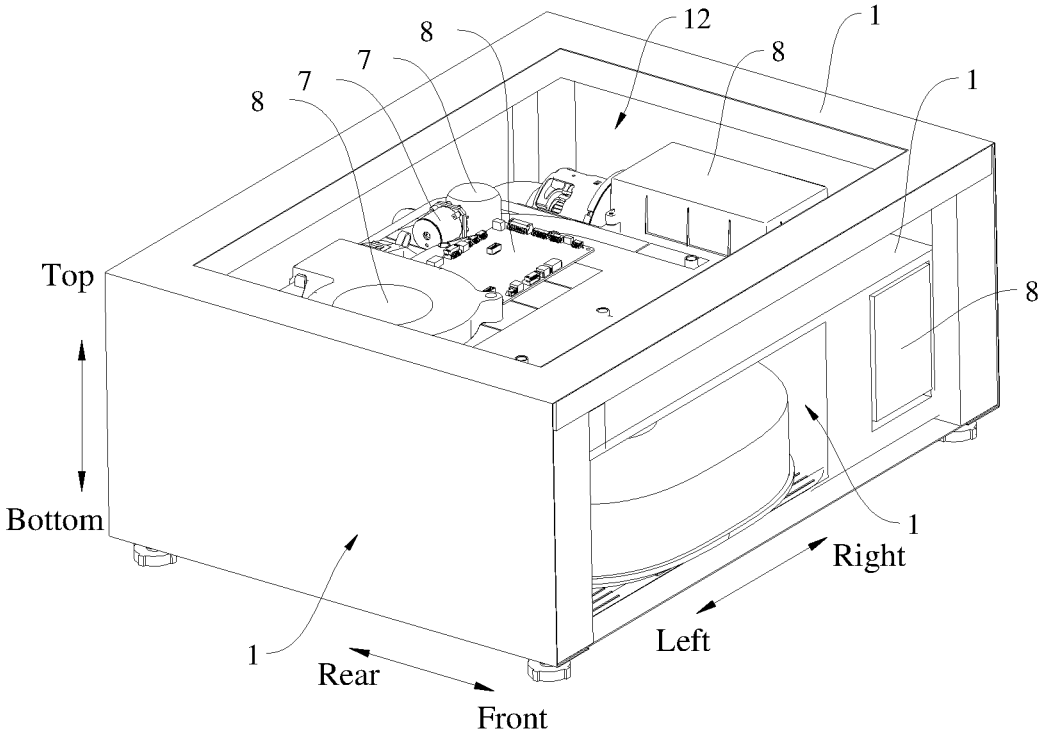
FIG. 2 is a schematic view of a cleaning station according to an embodiment of the present application.
Figure 3:
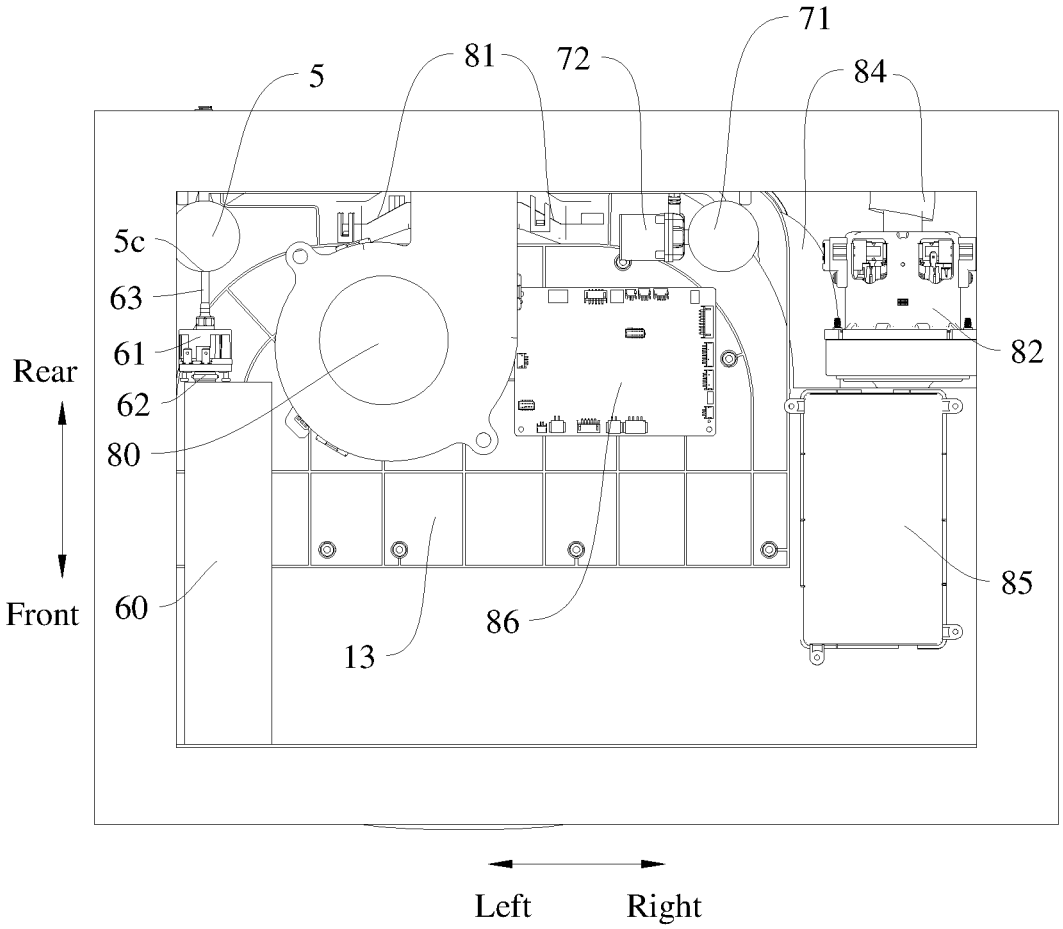
FIG. 3 is another schematic view showing the cleaning station in FIG. 2 from another viewpoint.

The cleaning base 100 in the present disclosure is used in a cleaning system 1000. Referring to FIGS. 1 to 3, the cleaning system 1000 in the present disclosure includes the cleaning base 100 in any one of the embodiments of the present disclosure, a laundry treatment device 200, and a floor cleaning device 300. The laundry treatment device 200 is arranged above the bottom frame 1. The floor cleaning device 300 is accommodated in a cleaning chamber 1*a*, and can be moved out of the cleaning chamber. That is, the cleaning system 1000 integrates both of the floor cleaning function and the laundry treatment function. The floor cleaning device 300 is configured to clean the floor, and the laundry treatment device 200 is configured to wash and/or dry clothes. The cleaning base 100 is arranged below the laundry treatment device 200, and a space below the laundry treatment device 200 provides the space for the cleaning base 100, so as to avoid the cleaning base 100 and the floor cleaning device 300 occupying extra ground.

The cleaning base 100 can impart functions, including but not limited to power supply, cleaning of a cleaning head 301, drying of the cleaning head 301, cleaning of the dust box 83, to the floor cleaning device 300.

The cleaning head 301 of the floor cleaning device 300 includes, but is not limited to, a mop or a roller brush. The cleaning head 301 can clean the floor by rolling, sliding or rotating relative to the floor.

The floor cleaning device 300 is an intelligent robot vacuum cleaner, that is, the floor cleaning device 300 includes a controller and a walking structure, and the controller can control the walking structure to walk autonomously and the cleaning head 301 to work autonomously. In one example, the walking structure is wheels, and the controller controls the wheels to rotate to drive the floor cleaning device 300 to move. The cleaning head 301 can clean the ground during the moving process of the floor cleaning device 300.

As an example, in one embodiment, the floor cleaning device 300 includes a first communication assembly, the cleaning base 100 includes a second communication assembly, and the floor cleaning device 300 and the cleaning base 100 can communicate with one another through the first and second communication assemblies. For example, when the cleaning head 301 of the floor cleaning device 300 needs to be cleaned, the floor cleaning device 300 can conduct the wireless communication through the first communication assembly and the second communication assembly, so as to return to the cleaning base 100 autonomously. For example, the first and second communication assemblies may include, but are not limited to, one or more of wireless data communication assemblies such as a Blue tooth assembly, a Wireless Fidelity (WIFI) assembly, a 4th Generation/5th Generation (4G/5G) communication assembly, or an infrared assembly.

The laundry treatment device 200 includes but is not limited to pulsator washing machines, drum washing machines, clothes dryers, washing and drying machines, etc.

A cleaning portion 1*b* for cleaning at least a part of the floor cleaning device 300 and a cleaning chamber 1*a* for accommodating the floor cleaning device 300 are formed inside the bottom frame 1. The water inlet pipeline 2 fluidly connects the cleaning portion 1*b* with a water source (tap water). Specifically, the cleaning chamber 1*a* is in communication with the cleaning portion 1*b* configured for cleaning the cleaning head 301 of the floor cleaning device 300. After the floor cleaning device 300 enters into the cleaning chamber 1*a*, water in the cleaning portion 1*b* can contact with the cleaning head 301.

There is no limit to the position of the cleaning portion 1*b*, the cleaning portion 1*b* can be arranged on a side wall of the cleaning chamber 1*a*, or the cleaning portion 1*b* can also be arranged at a bottom of the cleaning chamber 1*a*. The structure of the cleaning portion 1*b* is not limited, and may be in the form of a basin or a box with an opening. In an exemplary embodiment, the cleaning portion 1*b* is a cleaning basin, and the bottom of the cleaning chamber 1*a* is recessed downward to form the cleaning basin. The cleaning head 301 of the floor cleaning device 300 may be placed in the cleaning basin for cleaning.

The manner for achieving the cleaning function of the cleaning head 301 is not limited, and the cleaning function may be realized by controlling the cleaning head 301 to be in contact with water and liquid in the cleaning portion 1*b* while rotating or vibrating by the controller of the floor cleaning device 300. The cleaning function may also be realized by providing a friction member such as a brush head in the cleaning basin. In this case, the cleaning function may be realized by contacting and rubbing between the brush head and the cleaning head 301 of the floor cleaning device 300.

In the cleaning base 100 of the embodiment of the present disclosure, the water inlet pipeline 2 is fluidly connected with the water source, so there is no need to provide a water storage structure with a large structural size for the cleaning base 100, and the overall structural size of the cleaning base 100 can be reduced. The water source may continuously supply water to the cleaning portion 1*b*, without the user having to manually supply the water to the water storage structure, thus increasing the automation level and operating convenience of the station.

Figure 6:
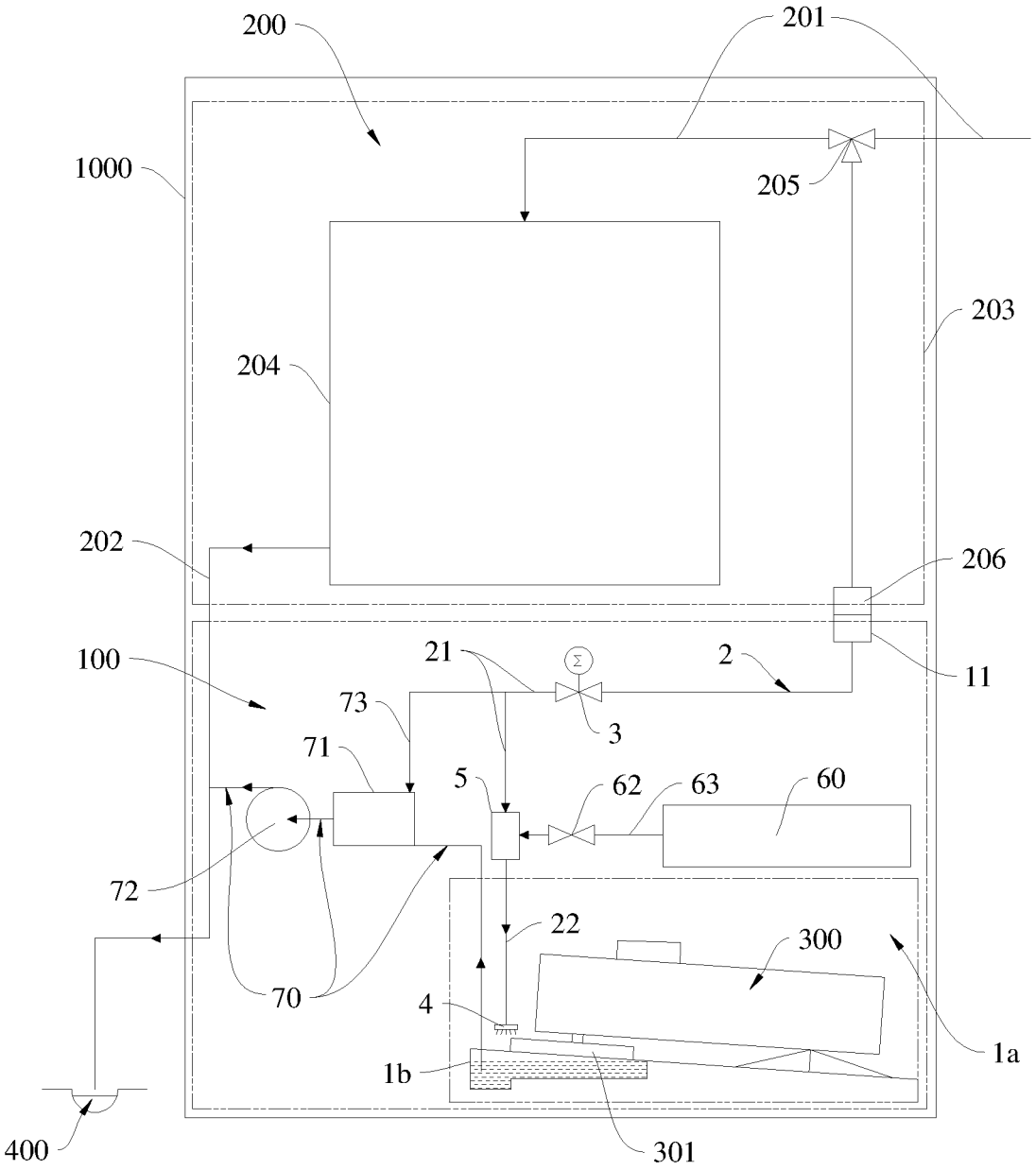
FIG. 6 is a schematic view showing the cleaning system in FIG. 1.

In one embodiment, referring to FIG. 6, a water inlet valve 3 is arranged in the water inlet pipeline 2. That is, the water inlet pipeline 2 introduces the water from the water source into the cleaning portion 1*b* through the water inlet valve 3. Due to the presence of the water inlet valve 3 in the water inlet pipeline 2, the characteristics of the water flow entering into the cleaning portion 1*b* can be controlled by water inlet valve 3. This is conducive to providing stable inlet water flow and ensuring high reliability of the cleaning work performed by the cleaning base 100 to the floor cleaning device 300.

In an embodiment, referring to FIG. 6, the laundry treatment device includes a water intake pipeline 201, the water inlet pipeline 2 is fluidly connected with the water intake pipeline 201, and the water intake pipeline 201 is fluidly connected with the water source. Specifically, the laundry treatment device 200 includes a washing tub 204 for washing clothes and a casing 203. The casing 203 enclose the washing tub 204. One end of the water intake pipeline 201 is fluidly connected with the washing tub 204, and the other end of the water intake pipeline 201 is fluidly connected with the water source to introduce the water from the water source into the washing tub 204. In the present disclosure, by connecting one end of the water inlet pipeline 2 to the water intake pipeline 201, the water inlet pipeline 2 and the water intake pipeline 201 share the signal water source. The single water source can supply water to both the laundry treatment device 200 and the cleaning base 100 at the same time, thus omitting the pipe joint between the cleaning base 100 and the water source, thereby reducing the modification to the tap water pipeline, reducing the product cost and allowing the high utilization rate of pipeline.

In one embodiment, a three-way valve 205 is arranged at a joint position between the water inlet pipeline 2 and the water intake pipeline 201. By controlling the three-way valve 205, it is possible to supply water simultaneously or respectively to the laundry treatment device 200 and the cleaning base 100.

In one embodiment, the laundry treatment device 200 includes a water intake valve arranged in the water intake pipeline 201. The water intake valve is configured to control the fluid communication of the water intake pipeline 201 to the water source. Specifically, the water intake valve is arranged upstream of the three-way valve 205.

Figure 4:
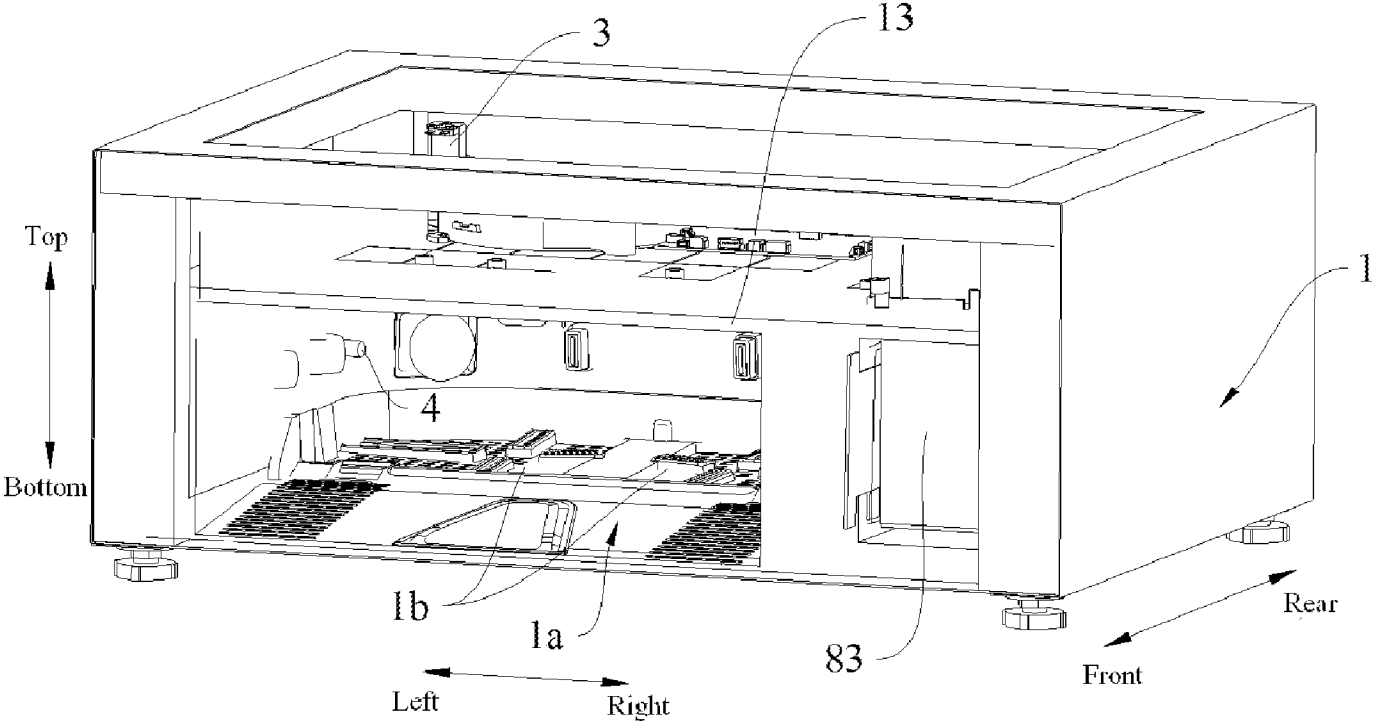
FIG. 4 is yet another schematic view showing the cleaning station in FIG. 2 from another viewpoint.

In an embodiment, referring to FIGS. 4 and 6, the cleaning base 100 includes a cleaning port 4 located in the cleaning chamber 1*a*, and the cleaning port 4 is arranged at a water outlet end of the water inlet pipeline 2. The water from the water inlet pipeline 2 flows into the cleaning portion 1*b* through the cleaning port 4. In one example, the cleaning port 4 may be located in cleaning portion 1*b*. In another example, the cleaning port 4 may also be located above cleaning portion 1*b*, and the water flow coming from the water inlet pipeline 2 flows directly out of the pipe port and falls into the cleaning portion 1*b*.

In one embodiment, the cleaning port 4 is a spray nozzle located above the cleaning portion 1*b*. The spray nozzle can change the water flow with a large flowing area into a plurality of slender water flows with a small flowing area, and spray them on the cleaning head 301 of the floor cleaning device 300, so that the water is more uniform and the water utilization efficiency is high.

In one embodiment, referring to FIG. 6, a top side of the bottom frame 1 is provided with a water inlet port 11, and the water inlet pipeline 2 is fluidly connected with the water inlet port 11. That is, the water inlet pipeline 2 is fluidly connected with the water intake pipeline 201 through the water inlet port 11.

In order to improve the installation efficiency and convenience of the pipe connection, in an exemplary embodiment, the bottom of the laundry treatment device 200 is provided with a water intake port 206 fluidly connected with the water inlet port 11 on the top side of the bottom frame 1, and the water intake pipeline 201 is fluidly connected with the water intake port 206. Specifically, the casing 203 is disposed on a top surface of the bottom frame 1, and the bottom frame 1 is connected to the casing 203 to support the laundry treatment device 200. The water intake pipeline 201 is located within the casing 203 and fluidly connected with the washing tub 204. One end of the water inlet pipeline 2 is fluidly connected with the water inlet port 11 on the top side of the bottom frame 1, the water intake pipeline 201 is fluidly connected with water intake port 206. The casing 203 is installed on the bottom frame 1. The water intake port 206 and water inlet port 11 are fluidly connected with each other, so that the water inlet pipeline 2 can be fluidly connected with the water intake pipeline 201 quickly and conveniently. Both of the water inlet pipeline 2 and the water intake pipeline 201 are located inside the cleaning system 1000, which allows a more compact structure, and avoids the external connection of the water inlet pipeline 2, and thus the overall appearance of the cleaning system 1000 is aesthetically pleasing.

In an exemplary embodiment, referring to FIGS. 3 to 5, the bottom frame 1 includes a support frame 12 and a base frame 13. A receiving cavity 12*a* is formed in the support frame 12, and the base frame 13 is located in the receiving cavity 12*a*. The cleaning portion 1*b* and the cleaning chamber 1*a* with an opening on the front side are formed in the base frame 13, and the water inlet valve 3 is located in the receiving cavity 12*a*. In an example, the water inlet port 11 is formed on the top side of the support frame 12, a water inlet pipeline 2 passes through the water inlet port 11 and is fluidly connected with the water intake pipeline 201. The casing 203 is arranged on the top side of the support frame 12, and the water inlet valve 3 is located in the receiving cavity 12*a* and above the base frame 13. That is, the support frame 12 is configured to support the overall structural weight of the laundry treatment device 200, and the function of the base frame 13 is the zoning and arrangement of the functional members of the cleaning base 100. In this way, a large weight is directly transmitted to the ground by the support frame 12, and the base frame 13 does not need to bear a large weight. Therefore, the base frame 13 may be made by a lighter and rustless material such as plastics, which reduces the material cost without affecting the overall structural safety of the cleaning base 100.

In one embodiment, the support frame 12 and the casing 203 may be separate elements. That is, the bottom frame 1 and casing 203 are manufactured separately and independently, this structure can facilitate the assembly of the cleaning system 1000 and facilitate the transportation of the bottom frame 1 and the casing 203.

In another embodiment, the support frame 12 and the casing 203 may be made in one piece. The one-piece structure gives the cleaning system 1000 a greater structural strength and a more aesthetically pleasing appearance.

In one embodiment, the water intake pipeline 201 and the water inlet pipeline 2 are located on the same side of the bottom frame 1. This facilitates the layout of the water inlet pipeline 2, and the pipeline between the water inlet pipeline 2 and the water intake pipeline 201 is shorter and the pipeline structure is more compact. Specifically, all of the water inlet valve 3, the water inlet pipeline 2 and the water intake pipeline 201 are located on the same side of bottom frame 1. In an exemplary embodiment, referring to FIGS.

2-5, all of the water intake pipeline 201, the water inlet pipeline 2 and the water inlet valve 3 are located on a rear side of the bottom frame 1.

It should be noted that the term "front" refers to the orientation towards the user, the term "rear" refers to the orientation opposite to the "front", the term "left" refers to the side corresponding to the user's left hand, and the term "right" is the opposite side to the "left" side.

In one embodiment, the water inlet valve 3 may be a flow limiting valve with a flow limiting function. That is, when the flow rate of the water flowing through the water inlet valve 3 is greater than a preset value, the water inlet valve 3 is closed or is partially closed to limit the flow rate. This prevents the flow rate of the water from the water injection passage from becoming too large.

In an embodiment, referring to FIGS. 5 and 6, the cleaning base 100 includes a pressure relief tank 5 disposed in the water inlet pipeline 2 and downstream of the water inlet valve 3. In an example, the pressure relief tank 5 is located in the receiving cavity 12*a* and disposed on the rear side of the base frame 13. That is, the water in the water inlet pipeline 2 flows first through the water inlet valve 3, then through the pressure relief tank 5 and then into the cleaning portion 1*b*. Specifically, the pressure relief tank 5 is a hollow structure provided with a pressure relief chamber. The pressure relief chamber in the pressure relief tank 5 can relieve the pressure and slow down the flow of the water, so that the water flow can flow at a suitable speed, thus avoiding the water splashing caused by the excessive water pressure in the water inlet passage.

In an embodiment, referring to FIGS. 5 and 6, the cleaning base 100 includes a detergent canister 60 in communication with the pressure relief tank 5. The detergent canister 60 is configured to receive the detergent. Specifically, the detergent canister 60 is located in the receiving cavity 12*a*, and the detergent canister 60 is provided with a hollow structure for accommodating a detergent chamber. The detergent in the detergent chamber can flow into the water inlet pipeline 2 through the pressure relief chamber. Because the pressure relief chamber plays the role of relieving the pressure and slowing the flow, the detergent and the water can be fully mixed in the pressure relief chamber, so that a better and more uniform mixing effect is achieved.

In an exemplary embodiment, referring to FIGS. 5 and 6, the cleaning base 100 includes a self-feeding pump 61 for pumping the detergent contained in the detergent canister 60. Specifically, the self-feeding pump 61 is located in the receiving cavity 12*a*. The cleaning base 100 further includes a feed pipeline 63, two ends of which are fluidly connected to the pressure relief tank 5 and the detergent canister 60 respectively. The self-feeding pump 61 is arranged in the feed pipeline 63 between the detergent canister 60 and the pressure relief tank 5, to pump the detergent contained in the detergent chamber.

The self-feeding pump 61 includes, but is not limited to, screw pump, plunger pump, diaphragm pumps or impeller pump.

In an embodiment, referring to FIGS. 5 and 6, the cleaning base 100 includes a switch valve 62 disposed in the feed pipeline 63 and between the self-feeding pump 61 and the detergent canister 60. By controlling the switch valve 62, it is possible to control the fluid communication between the detergent canister 60 and the pressure relief tank 5, and it is possible to prevent the water in the pressure relief chamber from flowing back into the detergent canister 60.

In one embodiment, an outlet of the detergent canister 60 is detachably connected to the switch valve 62. When the detergent in detergent canister 60 is used up, the switch valve 62 is controlled to be closed, so as to prevent the water in the pressure relief chamber overflowing from self-feeding pump 61 when replacing a new detergent pump, and thus the working reliability is improved.

In an example, the switch valve 62 includes but is not limited to a solenoid valve, and the switch valve 62 may be electrically connected to a master chip 86 of the cleaning base 100. The switch valve 62 may be controlled by the master chip 86.

In an embodiment, referring to FIGS. 5 and 6, the pressure relief tank 5 is located in front of the water inlet valve 3. In an example, the pressure relief tank 5 and the water inlet valve 3 are located substantially on the same straight line extending in a front-rear direction. Specifically, in one embodiment, the detergent canister 60 is located in front of the pressure relief tank 5, and the feed pipeline 63 extends in the front-rear direction. With this arrangement, the space of the station in the horizontal direction can be fully utilized, the height of the cleaning base 100 can be reduced, and a pipeline distance between the pressure relief tank 5, the water inlet valve 3 and the detergent canister 60 is shorter and the structure is more compact.

In an embodiment, referring to FIGS. 3, 5 and 6, the pressure relief tank 5 includes a liquid inlet 5*a* fluidly connected with a water outlet of the water inlet valve 3, a liquid outlet 5*b* fluidly connected with the cleaning portion 1*b*, and a feed inlet 5*c* fluidly connected with the detergent canister 60. The height of the liquid inlet 5*a* and the height of the feed inlet 5*c* are higher than that of the liquid outlet 5*b*. With this arrangement, the liquid flowing into the pressure relief tank 5 along the liquid inlet 5*a* and the feed inlet 5*c* will flow downward to the liquid outlet 5*b* by its own gravity, so that the liquid in the pressure relief chamber is difficult to flow back. Specifically, the water inlet pipeline 2 includes a first water inlet pipe 21 and a second water inlet pipe 22. The first water inlet pipe 21 extends in the front-rear direction, and two ends of the first water inlet pipe 21 are fluidly connected to the liquid inlet 5*a* and the water outlet of the water inlet valve 3, respectively. Two ends of the second water inlet pipe 22 are fluidly connected to the liquid outlet 5*b* and the cleaning portion 1*b*, respectively. Two ends of the feed pipeline 63 are fluidly connected to the feed inlet 5*c* and the detergent canister 60, respectively.

In one embodiment, the liquid inlet 5*a* and the feed inlet 5*c* are disposed on a peripheral sidewall of the pressure relief tank 5 and on an upper portion of the pressure relief tank 5; and/or, the liquid outlet 5*b* is arranged at a bottom of the pressure relief tank 5.

In an embodiment, referring to FIGS. 3, 5 and 6, on each of the left and right sides of the cleaning chamber 1*a*, a cleaning port 4 is provided. The second water inlet pipe 22 includes a shunt pipe 221, a first branch pipe 222 and a second branch pipe 223. One end of the shunt pipe 221 is fluidly connected with the liquid outlet 5*b*, and the other end of the shunt pipe 221 is fluidly connected with a water inlet of the first branch pipe 222 and a water inlet of the second branch pipe 223. A water outlet of the first branch pipe 222 is fluidly connected with the cleaning port 4 located on the left side of cleaning chamber 1*a*, and a water outlet of the second branch pipe 223 is fluidly connected with the cleaning port 4 located on the right side of cleaning chamber 1*a*. In this way, the first branch pipe 222 and the second branch pipe 223 can further divert the water flow of the water inlet pipeline 2, and the cleaning ports 4 at different positions simultaneously supply water to the cleaning portion 1*b*, so that the water supply is more uniform. Even if either one of the first branch pipe 222 or the second branch pipe 223 is blocked, another one of the first branch pipe and the second branch pipe 223 can supply water, so that the water supply is more reliable.

In an embodiment, referring to FIGS. 3, 5 and 6, the cleaning base 100 includes a water discharge pipeline 70 fluidly connecting the cleaning portion 1*b* with a water outlet pipeline 202 of the laundry treatment device 200. Specifically, one end of the water outlet pipeline 202 of the laundry treatment device 200 is fluidly connected to the washing tub 204 (bucket), and the other end of the water outlet pipeline 202 is fluidly connected to the outside, for example, to an external floor drain 400 or a sewer pipe, so as to discharge the water in the washing tub 204. By connecting the water discharge pipeline 70 to the water outlet pipeline 202, the water outlet of the same water outlet pipeline 202 in the present disclosure can discharge either the water in the washing tub 204 or the water in the cleaning portion 1*b*, thus reducing the modification to the user's sewer pipeline and improving the utilization rate of the pipeline.

In an embodiment, referring to FIGS. 3, 5 and 6, the cleaning base 100 includes a water discharge tank 71, a water discharge pump 72 and a water supplementing pipeline 73. The water discharge pump 72 and the water discharge tank 71 are arranged in the water discharge pipeline 70. The water discharge pump 72 is located downstream of the water discharge tank 71. Two ends of the water supplementing pipeline 73 are fluidly connected to the water discharge tank 71 and the water inlet pipeline 2, respectively. In an example, all of the water discharge tank 71, the water discharge pump 72, and the water supplementing pipeline 73 are located within the receiving cavity 12*a*. In this way, not only the water discharge tank 71 and water discharge pump 72 can be prevented from being exposed, but also the water discharge tank 71 and the water discharge pump 72 can be prevented from coming into contact with the liquid in the cleaning portion 1*b*. Specifically, the water discharge tank 71 is a hollow structure with a water discharge cavity formed inside. The water discharge pump 72 may be an impeller pump. That is to say, since the water discharge pipeline 70 is fluidly connected to the cleaning portion 1*b*, the liquid in the cleaning portion 1*b* may be discharged to the outside along the water discharge pipeline 70 under the control of water discharge pump 72. In addition, the water discharge tank 71 and the water supplementing pipeline 73 may ensure the normal discharge of the water discharge pump 72. The water supplementing pipeline 73 is configured to introduce water from the water inlet pipeline 2 into the water discharge tank 71, so that the liquid exists in the water discharge pipeline 70 between the water discharge tank 71 and the cleaning portion 1*b*, thereby facilitating the start-up of the water discharge pump 72 and improving the discharge efficiency.

In an embodiment, referring to FIGS. 3 and 5, all of the water discharge tank 71, the water discharge pump 72 and the water outlet pipeline 202 are located on the same side of the bottom frame 1. This facilitates the layout of the water discharge pipeline 70, and the pipeline between the water discharge pipeline 70 and the water outlet pipeline 202 is shorter and the pipeline structure is more compact. In an exemplary embodiment, referring to FIGS. 3 and 5, both of the water discharge pump 72 and the water discharge tank 71 are located above the base frame 13 and on the right rear side of the base frame 13.

Specifically, in one embodiment, one end of the water supplementing pipeline 73 is connected to a peripheral sidewall of the water discharge tank 71 and is located at an upper part of the water discharge tank 71, and the other end of the water supplementing pipeline 73 is fluidly connected to the first water inlet pipe 21. The water supplementing pipeline 73 extends in the left-right direction and is located on the rear side of the base frame 13 to facilitate the layout of the water supplementing pipeline 73 and shorten the length of the water supplementing pipeline 73.

In an embodiment, referring to FIGS. 2 to 5, the cleaning base 100 includes an air blower 80 and a drying duct 81 for providing a drying function to the floor cleaning device 300. The air blower 80 is arranged in the receiving cavity 12*a* and above the base frame 13. The drying duct 81 fluidly connects the air blower 80 with the cleaning chamber 1*a*, and is arranged in the receiving cavity 12*a* and on the rear side of the base frame 13. The drying duct 81 circulates air into the cleaning chamber 1*a* to quickly dry the cleaning head 301 of the floor cleaning device 300.

In an embodiment, referring to FIGS. 2 to 5, the cleaning base 100 includes a dust collecting motor 82 for dust collection, a dust box 83 disposed within the base frame 13, and a dust collecting pipeline 84 disposed in the receiving cavity 12*a*. The dust collecting pipeline 84 fluidly connects the cleaning chamber 1*a* with the dust box 83, the dust collecting motor 82 is arranged in the dust collecting pipeline 84, and both the dust box 83 and the dust collecting motor 82 are arranged on the right side of the base frame 13.

The dust collecting motor 82 is configured to generate a negative pressure in the dust box 83. When the dust collecting motor 82 is operated, a negative pressure is generated in an inner space of the dust box 83, so that the dust collecting pipeline 84 is in a negative pressure environment. Debris in the dust storage space of the floor cleaning device 300 are sucked into the dust box 83 under the action of the negative pressure, thus realizing the automatic dust discharge of the floor cleaning device 300 without performing the manual dust discharge for the floor cleaning device 300 by users.

In an embodiment, referring to FIGS. 2 to 5, the cleaning base 100 includes a power supply assembly 85 and a master chip 86 located within the receiving cavity 12*a*. The power supply assembly 85 is configured supply power to various power-consuming components of the cleaning base 100, including but not limited to the second communication assembly, the master chip 86, the water inlet valve 3, the self-feeding pump 61, the switch valve 62, the water discharge pump 72, the air blower 80, and the dust collecting motor 82, etc. The master chip 86 is arranged in the middle area above the base frame 13. The master chip 86 is configured for controlling the actions of the second communication assembly, the water inlet valve 3, the self-feeding pump 61, switch valve 62, the water discharge pump 72, the air blower 80 and the dust collecting motor 82, respectively.

In one embodiment, the cleaning base 100 includes a charging terminal. The power supply assembly 85 is configured to convert the alternating current into the direct current. The charging terminal charges the floor cleaning device 300 by the direct current. After the floor cleaning device 300 is returned to the cleaning chamber 1*a*, the ground cleaning device may be electrically connected to the charging terminal to charge the ground cleaning device.

The various embodiments/examples in the present disclosure can be combined with each other as long as they do not conflict with each other. What described are merely preferable embodiments of the disclosure, and are not intended to limit the disclosure. Those skilled in the art should understand that the present disclosure may have various modifications and variations. All modifications, replacements and improvements made within the spirit and principles of the disclosure should be included within the scope of protection of the disclosure.

The invention claimed is:

1. A cleaning base comprising:

a bottom frame, wherein a cleaning portion for cleaning at least a part of a floor cleaning device and a cleaning chamber for accommodating the floor cleaning device are formed inside the bottom frame, a water inlet pipeline fluidly connecting the cleaning portion with a water source;

a water inlet valve arranged in the water inlet pipeline; and a pressure relief tank arranged in the water inlet pipeline and located downstream of the water inlet valve, wherein the pressure relief tank is configured to relieve a pressure and slow down flow of water downward along the water inlet pipeline from the water inlet valve to the cleaning portion, wherein:

the pressure relief tank comprises a liquid inlet fluidly connected with a water outlet of the water inlet valve, a liquid outlet fluidly connected with the cleaning portion, and a feed inlet fluidly connected with a detergent canister, a height of the liquid inlet and a height of the feed inlet are higher than that of the liquid outlet, the water inlet pipeline comprises a first water inlet pipe and a second water inlet pipe, two ends of the first water inlet pipe are fluidly connected to the liquid inlet and the water outlet of the water inlet valve respectively, and two ends of the second water inlet pipe are fluidly connected to the liquid outlet and the cleaning portion respectively, and the cleaning base comprises a water discharge tank, a water discharge pump and a water supplementing pipeline, the water discharge pump and the water discharge tank are arranged in a water discharge pipeline, the water discharge pump is located downstream of the water discharge tank, two ends of the water supplementing pipeline are fluidly connected to the water discharge tank and the water inlet pipeline respectively.

2. The cleaning base according to claim 1, wherein the cleaning base comprises a cleaning port located in the cleaning chamber, and the cleaning port is arranged at a water outlet of the water inlet pipeline.

3. The cleaning base according to claim 1, wherein a top side of the bottom frame is provided with a water inlet port, and the water inlet pipeline is fluidly connected with the water inlet port.

4. The cleaning base according to claim 1, wherein the bottom frame comprises a support frame and a base frame, a receiving cavity is formed in the support frame, the base frame is located in the receiving cavity, the cleaning portion and the cleaning chamber having an opening on a front side are formed in the base frame, and the water inlet valve is located in the receiving cavity.

5. The cleaning base according to claim 4, wherein the cleaning base further comprises an air blower and a drying duct, the air blower is arranged in the receiving cavity and above the base frame, and the drying duct fluidly connects the air blower with the cleaning chamber.

6. The cleaning base according to claim 4, wherein the cleaning base further comprises a dust collecting motor, a dust box disposed within the base frame and a dust collecting pipeline disposed in the receiving cavity, and the dust collecting pipeline fluidly connects the cleaning chamber with the dust box.

7. The cleaning base according to claim 1, wherein the cleaning base comprises the detergent canister in communication with the pressure relief tank.

8. The cleaning base according to claim 7, wherein the cleaning base comprises a self-feeding pump configured to pump a detergent contained in the detergent canister into the pressure relief tank.

9. The cleaning base according to claim 8, wherein the cleaning base further comprises a feed pipeline and a switch valve, two ends of the feed pipeline are fluidly connected to the pressure relief tank and the detergent canister respectively, and the switch valve is disposed in the feed pipeline and between the self-feeding pump and the detergent canister.

10. The cleaning base according to claim 7, wherein the pressure relief tank and the water inlet valve are located on a same straight line extending in a front-rear direction, and the detergent canister is located in front of the pressure relief tank.

11. The cleaning base according to claim 1, wherein the cleaning base comprises the water discharge pipeline, and the water discharge pipeline is fluidly connecting the cleaning portion with a water outlet pipeline of a laundry treatment device.

12. A cleaning system comprising:

the cleaning base according to claim 1, a laundry treatment device arranged above the bottom frame, and a floor cleaning device which is movable into and out of the cleaning chamber.

13. The cleaning system according to claim 12, wherein the laundry treatment device comprises a water intake pipeline, the water inlet pipeline is fluidly connected with the water intake pipeline, and the water intake pipeline is fluidly connected with the water source.

14. The cleaning system according to claim 13, wherein a bottom of the laundry treatment device is provided with a water intake port fluidly connected with a water inlet port on a top side of the bottom frame, and the water intake pipeline is fluidly connected with the water intake port.

15. The cleaning system according to claim 13, wherein the water intake pipeline and the water inlet pipeline are located on the same side of the bottom frame.

* * * * *